US011225760B2

(12) United States Patent
Impola et al.

(10) Patent No.: US 11,225,760 B2
(45) Date of Patent: Jan. 18, 2022

(54) CONSTRUCTION VEHICLE

(71) Applicant: Caterpillar Paving Products Inc., Brooklyn Park, MN (US)

(72) Inventors: Todd Alex Impola, Minnetonka, MN (US); Nicholas Alan Oetken, Brooklyn Park, MN (US); Eric Arden Hansen, Big Lake, MN (US); John Lee Marsolek, Watertown, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 56 days.

(21) Appl. No.: 16/879,832

(22) Filed: May 21, 2020

(65) Prior Publication Data

US 2021/0363705 A1 Nov. 25, 2021

(51) Int. Cl.
*E01C 19/28* (2006.01)
*E02D 3/074* (2006.01)
*E01C 19/26* (2006.01)

(52) U.S. Cl.
CPC ..... *E01C 19/286* (2013.01); *E01C 19/266* (2013.01); *E02D 3/074* (2013.01)

(58) Field of Classification Search
CPC ..... E01C 19/266; E01C 19/286; E02D 3/074
USPC ..... 404/84.05, 113, 117
See application file for complete search history.

(56) References Cited

U.S. PATENT DOCUMENTS 3,814,531 A * 6/1974 Carnahan ..... B62D 53/02 404/117
4,350,460 A * 9/1982 Schmelzer ..... E01C 19/28 404/117
4,568,218 A * 2/1986 Orzal ..... B06B 1/161 404/117
6,752,560 B2 * 6/2004 Wilson ..... F04D 29/044 403/1
8,393,826 B1 * 3/2013 Marsolek ..... E01C 19/286 404/117
10,234,033 B2 3/2019 Narita et al.
10,428,941 B2 10/2019 Thompson
2015/0191880 A1 * 7/2015 Oetken ..... E01C 19/286 404/72
2019/0154148 A1 5/2019 Ninomiya et al.

FOREIGN PATENT DOCUMENTS

CN 206439391 8/2017
CN 209164574 7/2019
DE 102010048343 4/2012
WO 201204041 1/2012

* cited by examiner

*Primary Examiner* — Raymond W Addie

(57) ABSTRACT

A construction vehicle includes a frame, at least one drum, and a vibratory system. The vibratory system includes a first eccentric weight, a second eccentric weight, and a shift assembly adapted to vary an amplitude of the vibratory system. The shift assembly includes a shaft member adapted to move along a first axis for changing a position of the first eccentric weight relative to the second eccentric weight. The shift assembly also includes an actuator and a fork assembly adapted to move the shaft member along the first axis. The fork assembly includes a fork fixedly coupled to the actuator. The fork assembly also includes a housing member concentrically disposed around the shaft member, wherein the fork is pivotally coupled to the housing member at a pair of pivot points defined proximate to the second end of the fork. The fork assembly further includes a bearing member.

20 Claims, 5 Drawing Sheets

CONSTRUCTION VEHICLE

TECHNICAL FIELD

The present disclosure relates to a construction vehicle, and more particularly, to a vibratory system associated with the construction vehicle.

BACKGROUND

A construction vehicle, such as a compactor, is used for compacting freshly laid material like asphalt, soil, and/or other compactable materials. The construction vehicle includes a single drum or a pair of drums that contacts the material to be compacted. The drums are equipped with a vibratory system in order to vibrate the drums at a desired vibrating frequency and vibrating amplitude. The vibratory system includes outer eccentric weights and inner eccentric weights. The vibrating amplitude can be controlled by adjusting an orientation of the outer eccentric weights with respect to the inner eccentric weights. In some cases, a shift assembly is used to adjust the orientation of the outer eccentric weights with respect to the inner eccentric weights.

The shift assembly includes a splined shaft, a shift fork, a bearing, a bearing housing, and a hydraulic actuator. The shift assembly moves the splined shaft axially to adjust the vibration amplitude of the vibratory system. The hydraulic actuator is actuated to move the splined shaft so that the vibration amplitude of the vibratory system can be adjusted, according to requirements.

Generally, the translation of the splined shaft induces a large moment on the bearing and the bearing housing. Due to this induced moment, an outer race or other components of the bearing may fail during vehicle operation. To avoid such bearing failures, a larger bearing needs to be installed in the shift assembly which in turn increases an overall cost of the vibratory system. Such large bearings also require an increased space for mounting thereof.

DE Patent Application Number 102010048343 describes a shift fork for a gearbox of a vehicle. The shift fork includes a shift collar and a plurality of shift fork shoes. The shift-fork with two sliding shift-fork shoes is displaced at a shift fork ends of the shift collar in an axial direction of a gearbox shaft. The shift-fork shoe engages with a radial groove of the shift collar in a sliding manner.

SUMMARY OF THE DISCLOSURE

In an aspect of the present disclosure, a construction vehicle is provided. The construction vehicle includes a frame. The construction vehicle also includes at least one drum supported by the frame. The construction vehicle further includes a vibratory system mounted within the at least one drum. The vibratory system includes a first eccentric weight. The vibratory system also includes a second eccentric weight concentric with the first eccentric weight. The vibratory system further includes a shift assembly adapted to vary an amplitude of the vibratory system based on a change in a position of the first eccentric weight relative to the second eccentric weight. The shift assembly includes a shaft member adapted to move along a first axis for changing the position of the first eccentric weight relative to the second eccentric weight. The shift assembly also includes an actuator disposed parallel to the shaft member. The shift assembly further includes a fork assembly adapted to move the shaft member along the first axis based on an actuation of the actuator. The fork assembly includes a fork defining a first end and a second end. The fork is fixedly coupled to the actuator proximate to the first end. The fork assembly also includes a housing member concentrically disposed around the shaft member, wherein the fork is pivotally coupled to the housing member at a pair of pivot points defined proximate to the second end of the fork. The fork assembly further includes a bearing member disposed between the housing member and the shaft member.

In another aspect of the present disclosure, a compactor is provided. The compactor includes a frame. The compactor also includes at least one drum supported by the frame. The compactor further includes a vibratory system mounted within the at least one drum. The vibratory system includes a first eccentric weight. The vibratory system also includes a second eccentric weight concentric with the first eccentric weight. The vibratory system further includes a shift assembly adapted to vary an amplitude of the vibratory system based on a change in a position of the first eccentric weight relative to the second eccentric weight. The shift assembly includes a shaft member adapted to move along a first axis for changing the position of the first eccentric weight relative to the second eccentric weight. The shift assembly also includes an actuator disposed parallel to the shaft member. The shift assembly further includes a fork assembly adapted to move the shaft member along the first axis based on an actuation of the actuator. The fork assembly includes a fork defining a first end and a second end. The fork is fixedly coupled to the actuator proximate to the first end. The fork assembly also includes a housing member concentrically disposed around the shaft member, wherein the fork is pivotally coupled to the housing member at a pair of pivot points defined proximate to the second end of the fork. The fork assembly further includes a bearing member disposed between the housing member and the shaft member.

Other features and aspects of this disclosure will be apparent from the following description and the accompanying drawings.

DETAILED DESCRIPTION

Figure 1:
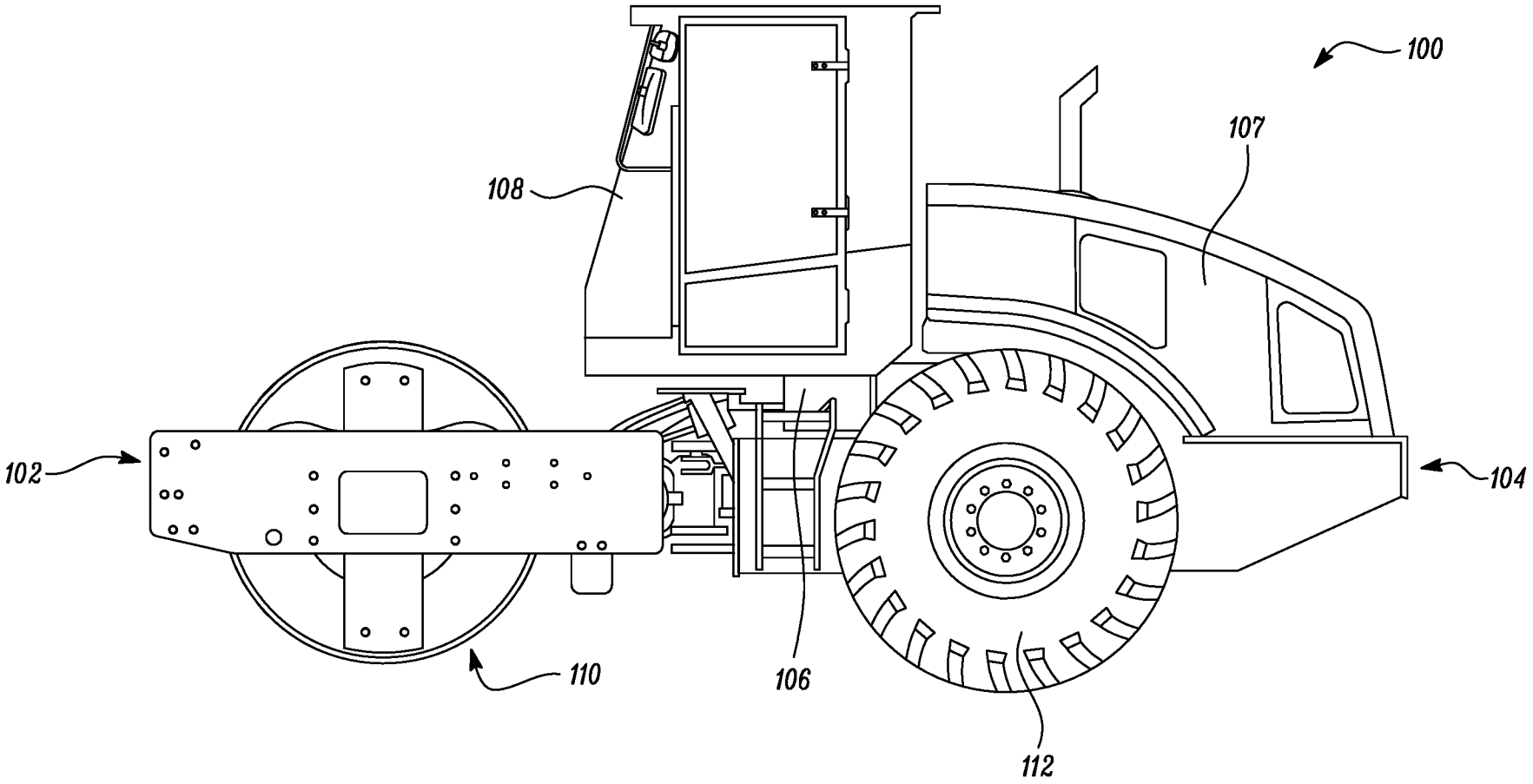
FIG. 1 is a side view of a construction vehicle, according to one embodiment of the present disclosure.

Wherever possible, the same reference numbers will be used throughout the drawings to refer to the same or like parts. Referring to FIG. 1, an exemplary construction vehicle 100 is illustrated. The construction vehicle 100 is embodied as a compactor herein. The construction vehicle 100 may be hereinafter interchangeably referred to as the compactor 100. Further, the construction vehicle 100 is embodied as a soil compactor herein. Alternatively, the construction vehicle 100 may embody another type of compactor, such as, a landfill compactor, an asphalt compactor, a pneumatic roller, a tandem vibratory roller, and the like.

Further, the construction vehicle 100 includes a front end 102 and a rear end 104. The construction vehicle 100 includes a frame 106. The frame 106 supports various components of the construction vehicle 100 thereon. The frame 106 defines an enclosure 107 proximate to the rear end 104. The construction vehicle 100 also includes a power source (not shown) mounted within the enclosure 107. The various components of the construction vehicle 100 are driven by the power source. The power source may be an engine such as an internal combustion engine, an electrical source like a series of batteries, etc. The construction vehicle 100 further includes an operator station 108. The operator station 108 may include various input devices and output devices to control vehicular operations.

Further, the construction vehicle 100 includes one or more drums 110 supported by the frame 106. In the illustrated example, the construction vehicle 100 includes a single drum 110. The drum 110 is disposed proximate to the front end 102 of the construction vehicle 100. In an embodiment, the drum 110 may include a pad-foot type drum with a number of segmented pads disposed over an outer surface of the drum 110. Further, the construction vehicle 100 includes an axle (not shown) driving a pair of wheels 112 disposed proximate to the rear end 104 of the construction vehicle 100. Typically, a rolling radius of the drum 110 and a rolling radius of the wheels 112 are equivalent. Together, the drum 110 and the wheels 112 act as ground engaging members for the construction vehicle 100. In other embodiments, the construction vehicle 100 may eliminate the wheels 112 and include another drum proximate to the rear end 104 of the construction vehicle 100.

Figure 2:
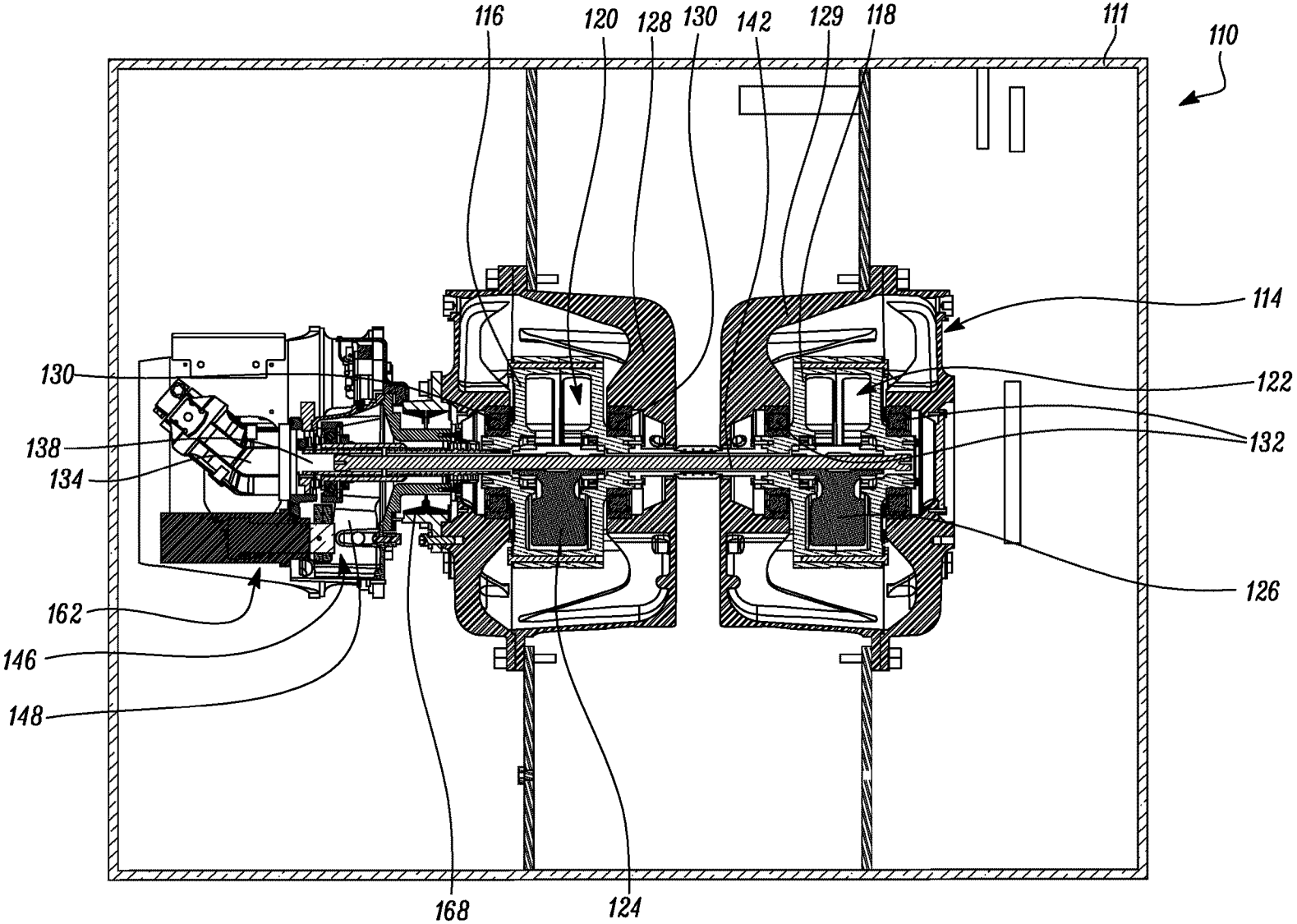
FIG. 2 is a cross-sectional view of a drum and a vibratory system associated with the construction vehicle of FIG. 1, according to one embodiment of the present disclosure.

FIG. 2 illustrates a cross-sectional view of the drum 110. The drum 110 includes a shell member 111. The shell member 111 contacts ground surfaces during a compaction operation or mobility of the construction vehicle 100. The construction vehicle 100 includes a vibratory system 114 mounted within the one or more drums 110. More particularly, the vibratory system 114 is mounted and supported within the shell member 111. The vibratory system 114 includes a first eccentric weight 116, 118. In the illustrated example, the vibratory system 114 includes two first eccentric weights 116, 118. The first eccentric weight 116, 118 define a hollow portion 120, 122. Each of the first eccentric weights 116, 118 include a two piece structure bolted together.

The vibratory system 114 also includes a second eccentric weight 124, 126 concentric with the first eccentric weight 116, 118. In the illustrated example, the vibratory system 114 includes two second eccentric weights 124, 126. The second eccentric weight 124, 126 is received within the hollow portion 120, 122 of the first eccentric weight 116, 118. The first eccentric weights 116, 118 and the second eccentric weights 124, 126 are enclosed in a corresponding pod housing 128, 129 disposed in the drum 110. Further, a first pair of bearings 130 are disposed between the pod housing 128 and the first eccentric weight 116. Moreover, a second pair of bearings 132 are disposed between the pod housing 129 and the first eccentric weight 118.

Further, the vibratory system 114 includes a motor 134 to spin the first eccentric weight 116, 118 and the second eccentric weight 124, 126. The motor 134 spins one or more components of the vibratory system 114. More particularly, the motor 134 spins a shaft member 136 (shown in FIG. 3), a first shaft 138, a second shaft 140 (shown in FIG. 3), and a third shaft 142. The motor 134 may be a hydraulic motor that operates based on power received from the power source, without any limitations. Further, an output of the motor 134 may be varied to vary a vibrating frequency of the vibratory system 114.

Figure 3:
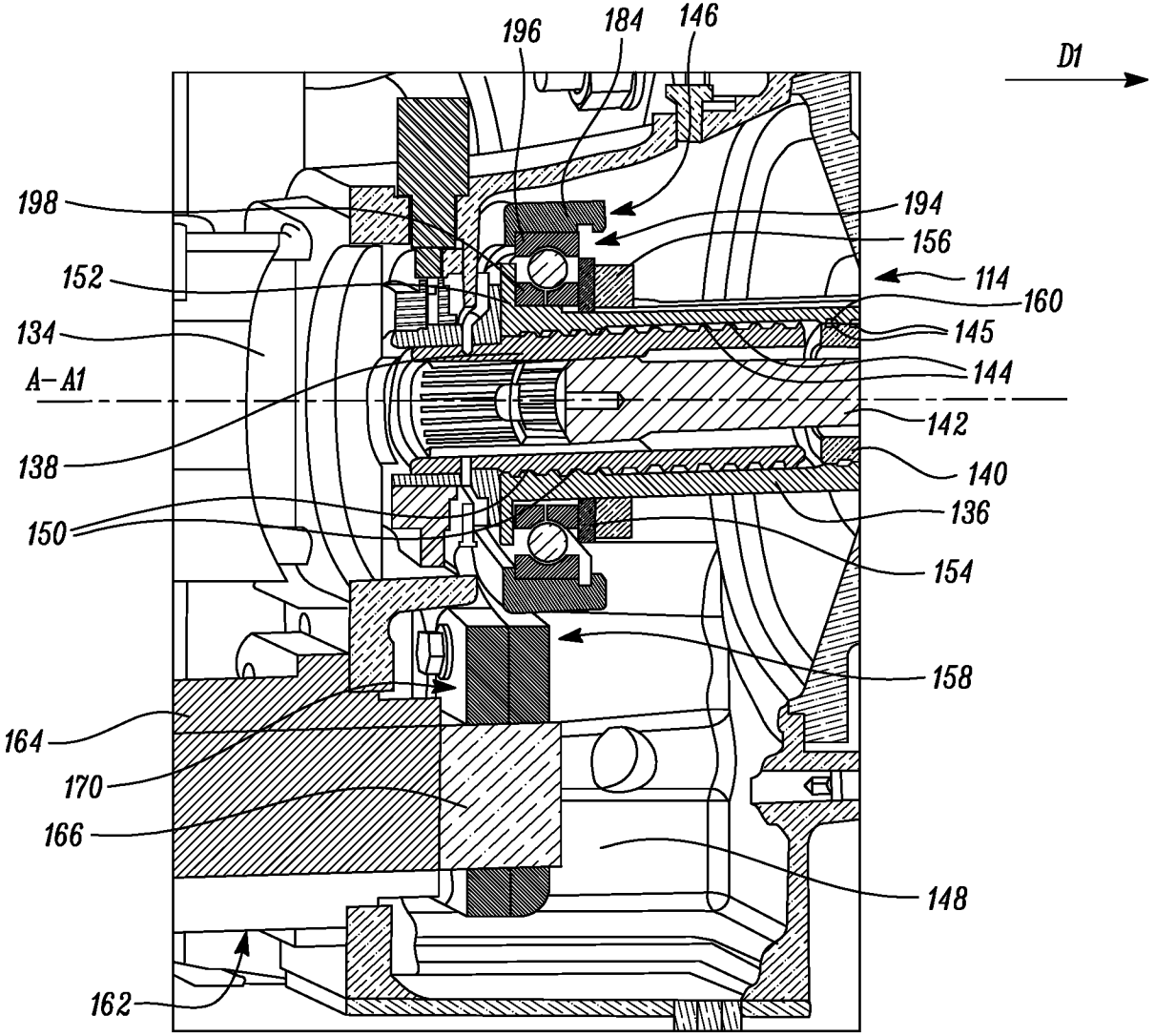
FIG. 3 illustrates a portion of the vibratory system of FIG. 2 including a shift assembly, according to one embodiment of the present disclosure.

Referring to FIG. 3, the vibratory system 114 includes the first shaft 138 rotatably coupled to the motor 134. The first shaft 138 includes a number of first external helical splines 144. The first external helical splines 144 extend along an outer surface of the first shaft 138. It should be noted that the first shaft 138 spins and in turn causes the second shaft 140, the shaft member 136, and the third shaft 142 to spin. Further, the vibratory system 114 includes the second shaft 140 driven by the motor 134 and coupled to the first eccentric weight 116, 118. The second shaft 140 spins the first eccentric weight 116, 118. The second shaft 140 includes a number of second external helical splines 145. The second external helical splines 145 extend along an outer surface of the second shaft 140. The vibratory system 114 also includes the third shaft 142 driven by the motor 134 and coupled with the second eccentric weight 124, 126. Further, the third shaft 142 spins the second eccentric weight 124, 126. More particularly, the third shaft 142 is coupled with the first shaft 138 such that the first shaft 138 spins the third shaft 142, which in turn spins the second eccentric weights 124, 126.

Further, the vibratory system 114 includes a shift assembly 146 to vary an amplitude of the vibratory system 114 based on a change in a position of the first eccentric weight 116, 118 relative to the second eccentric weight 124, 126. The shift assembly 146 is mounted in the drum 110. More particularly, the shift assembly 146 is enclosed in a housing 148 disposed in the drum 110. Further, a pair of taper roller bearings 168 (shown in FIG. 2) is positioned between the housing 148 and the pod housing 128. It should be noted that each of the first shaft 138, the second shaft 140, the third shaft 142, and the shaft member 136 spin at the same speed unless the shift assembly 146 is operated to vary the amplitude of the vibratory system 114.

Further, the shift assembly 146 includes the shaft member 136 that moves along a first axis "A-A1" for changing the position of the first eccentric weight 116, 118 relative to the second eccentric weight 124, 126. When the shift assembly 146 is activated, the shaft member 136 moves in a first direction "D1". It should be noted that the movement of the shaft member 136 in the first direction "D1" causes the amplitude of the vibratory system 114 to reduce. Further, the movement of the shaft member 136 in a direction opposite to the first direction "D1" causes the amplitude of the vibratory system 114 to increase.

The shaft member 136 includes a flange 152. The shaft member 136 is surrounded by a washer 154 and a bearing nut 156. The shaft member 136 includes a number of first internal helical splines 150 that engages with the number of first external helical splines 144 on the first shaft 138. The first internal helical splines 150 extend along a portion of an outer surface of the shaft member 136 proximate to the flange 152 of the shaft member 136. Further, the shaft member 136 includes a number of second internal helical splines 160 that engage with the number of second external helical splines 145 on the second shaft 140. The second internal helical splines 160 extend along a portion of the outer surface of the shaft member 136. The second internal helical splines 160 are disposed proximate to an end that is opposite to the flange 152.

Further, the shift assembly 146 includes an actuator 162 disposed parallel to the shaft member 136. The actuator 162 includes a cylinder 164 and a rod member 166. The actuator 162 may be hydraulically actuated, pneumatically operated, or electrically actuated. The shaft member 136 is movable along the first axis "A-A1" based on the actuation of the actuator 162. The actuator 162 may be actuated based on inputs from a control module (not shown) in order to vary the amplitude of the vibratory system 114.

Figure 4:
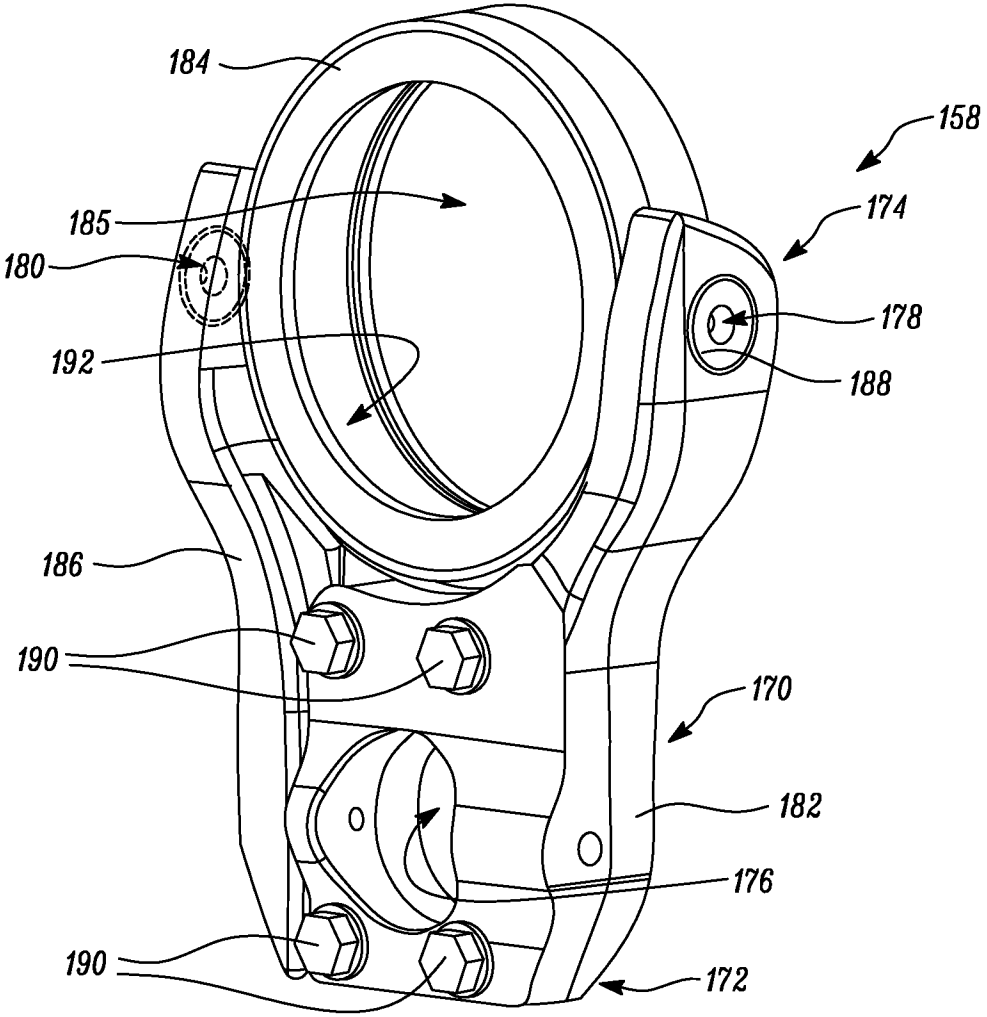
FIG. 4 is a perspective view of a fork assembly associated with the shift assembly of FIG. 3, according to one embodiment of the present disclosure.

Further, the shift assembly 146 includes the fork assembly 158 that moves the shaft member 136 along the first axis "A-A1" based on the actuation of the actuator 162. As shown in FIG. 4, the fork assembly 158 includes a fork 170 defining a first end 172 and a second end 174. The fork 170 is fixedly coupled to the actuator 162 proximate to the first end 172. The fork 170 defines a first through-aperture 176 to receive a portion of the actuator 162 for fixedly coupling the fork assembly 158 with the actuator 162. More particularly, the first through-aperture 176 is defined proximate to the first end 172 and receives a portion of the rod member 166. In an example, the rod member 166 may be welded to the fork 170.

The fork 170 is pivotally coupled to a housing member 184 at a pair of pivot points 178, 180 defined proximate to the second end 174 of the fork 170. More particularly, the fork 170 includes a first fork arm 182 pivotally coupled to the housing member 184 at the first pivot point 178 and a second fork arm 186 pivotally coupled to the housing member 184 at the second pivot point 180. The first and second pivot points 178, 180 allows relative motion between the fork 170 and the housing member 184 during the movement of the shaft member 136. More particularly, a first pivot pin 188 pivotally couples the first fork arm 182 with the housing member 184 and a second pivot pin 189 pivotally couples the second fork arm 186 with the housing member 184.

Further, a design of the first and second fork arms 182, 186 is such that the first through-aperture 176 is defined when the first fork arm 182 is coupled with the second fork arm 186. The first fork arm 182 is removably coupled with the second fork arm 186 using a number of mechanical fasteners 190. The mechanical fasteners 190 may include a bolt, a screw, a pin, a rivet, and the like. In the illustrated example, the first and second fork arms 182, 186 are removably coupled using four mechanical fasteners 190. However, a total number of the mechanical fasteners 190 may vary as per application requirements. Further, the first fork arm 182 includes a first through-hole (not shown) and the second fork arm 186 includes a second through-hole (not shown). The first and second through-holes are in alignment with each other.

Figure 5:
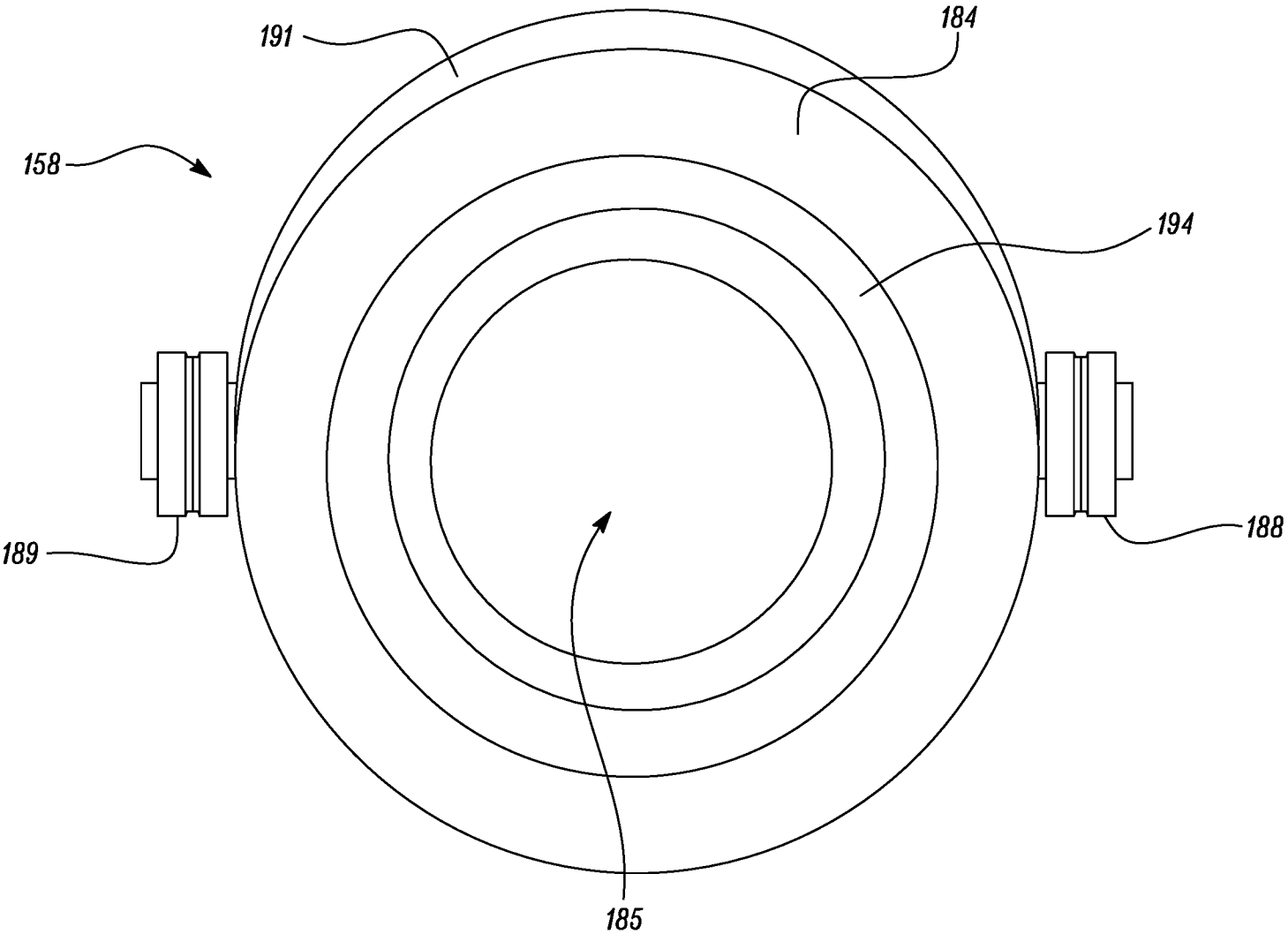
FIG. 5 is a perspective view illustrating a housing member, a first pivot pin, and a second pivot pin associated with the fork assembly of FIG. 4.

The fork assembly 158 also includes the housing member 184 concentrically disposed around the shaft member 136 (see FIG. 3). The housing member 184 is circular in shape. Further, the housing member 184 defines a first groove 192 and an opening 185. The opening 185 receives the bearing member 194, the shaft member 136, and the first shaft 138 therethrough. Referring now to FIG. 5, the first pivot pin 188 and the second pivot pin 189 are embodied as extrusions that project from an outer surface 191 of the housing member 184. The first and second pivot pins 188, 189 may be integrally coupled with the housing member 184. The first and second pivot pins 188, 189 are generally circular in shape. Further, the first pivot pin 188 aligns with the first through-hole in the first fork arm 182 (see FIG. 4) and the second pivot pin 189 aligns with the second through-hole in the second fork arm 186 (see FIG. 4) for pivotally coupling the fork 170 with the housing member 184.

Referring now to FIG. 3, the fork assembly 158 further includes the bearing member 194 disposed between the housing member 184 and the shaft member 136. The shaft member 136 is rotatably mounted within the bearing member 194. In the illustrated example, the bearing member 194 includes ball bearings. Further, a portion of an outer race 196 of the bearing member 194 is received within the first groove 192 (see FIG. 4). Moreover, a portion of an inner race 198 of the bearing member 194 is received within a second groove (not shown) formed by the flange 152, the shaft member 136, and the washer 154. Thus, the bearing member 194 is retained between the shaft member 136 and the housing member 184.

When the amplitude of the vibratory system 114 needs to be reduced, the fork 170 is translated so that the first eccentric weights 116, 118 phase out with respect to the second eccentric weights 124, 126. More particularly, the actuator 162 is actuated and the rod member 166 moves causing the fork 170 to move and pivot relative to the housing member 184 at the first and second pivot points 178, 180. Further, the movement of the fork 170 causes the shaft member 136 to move along the first axis "A-A1".

Such a movement of the shaft member 136 causes the first and second internal helical splines 150, 160 of the shaft member 136 to engage with another set of first and second external helical splines 144, 145 of the first and second shafts 138, 140, respectively. More particularly, the shifting of the shaft member 136 causes the second shaft 140 to rotate with respect to the third shaft 142. As the first eccentric weights 116, 118 are coupled to the second shaft 140 and the second eccentric weights 124, 126 are coupled to the third shaft 142, the rotation of the second shaft 140 with respect to the third shaft 142 causes the first eccentric weights 116, 118 to rotate with respect to the second eccentric weights 124, 126. Further, the relative motion between the first eccentric weights 116, 118 and the second eccentric weights 124, 126 changes a combined center of gravity of the first eccentric weights 116, 118 and the second eccentric weights 124, 126. The change in the combined center of gravity of the first eccentric weights 116, 118 and the second eccentric weights 124, 126 changes an amplitude of the vibratory system 114. When the shaft member 136 stops moving further along the first axis "A-A1", the first shaft 138, the second shaft 140, the third shaft 142, and the shaft member 136 start spinning at the same speed. Moreover, when the amplitude of the vibratory system 114 is to be increased, the rod member 166 retracts and the shaft member 136 moves in the direction that is opposite to the first direction "D1" to phase in the first eccentric weights 116, 118 relative to the second eccentric weights 124, 126.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure relates to the fork assembly 158 associated with the shift assembly 146. The fork assembly 158 includes the fork 170 that is pivotally coupled with the housing member 184 at the first and second pivot points 178, 180. During operation, when the fork 170 is translated by the actuator 162, the first and second pivot points 178, 180 bear a moment load during the shifting of the fork 170. As the first and second pivot points 178, 180 experience the moment load instead of the bearing member 194 or the housing member 184, a probability of failure of the bearing member 194 or the housing member 184 during shifting of the fork 170 and the shaft member 136 is reduced.

As the moment load is subjected to the first and second pivot points 178, 180 rather than the bearing member 194, a compact and cost effective bearing member 194 may be installed in the shift assembly 146. More particularly, incorporation of the first and second pivot points 178, 180 in the fork assembly 158 eliminates requirement of large bearings thereby reducing a cost associated with the vibratory system 114.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A construction vehicle comprising:
- a frame;
- at least one drum supported by the frame; and
- a vibratory system mounted within the at least one drum, the vibratory system comprising:
  - a first eccentric weight;
  - a second eccentric weight concentric with the first eccentric weight; and
  - a shift assembly adapted to vary an amplitude of the vibratory system based on a change in a position of the first eccentric weight relative to the second eccentric weight, wherein the shift assembly includes:
    - a shaft member adapted to move along a first axis for changing the position of the first eccentric weight relative to the second eccentric weight;
    - an actuator disposed parallel to the shaft member; and
    - a fork assembly adapted to move the shaft member along the first axis based on an actuation of the actuator, wherein the fork assembly includes:
      - a fork defining a first end and a second end, wherein the fork is fixedly coupled to the actuator proximate to the first end;
      - a housing member concentrically disposed around the shaft member, wherein the fork is pivotally coupled to the housing member at a pair of pivot points defined proximate to the second end of the fork; and
      - a bearing member disposed between the housing member and the shaft member.

2. The construction vehicle of claim 1, wherein the fork defines a first through-aperture adapted to receive a portion of the actuator for fixedly coupling the fork assembly with the actuator.

3. The construction vehicle of claim 1, wherein the vibratory system further includes a motor adapted to spin each of the first and second eccentric weights.

4. The construction vehicle of claim 3, wherein the vibratory system further includes a third shaft driven by the motor and coupled with the second eccentric weight.

5. The construction vehicle of claim 3, wherein the vibratory system further includes a first shaft driven by the motor, wherein the first shaft includes a plurality of first external helical splines.

6. The construction vehicle of claim 5, wherein the shaft member includes a plurality of first internal helical splines adapted to engage with the plurality of first external helical splines on the first shaft.

7. The construction vehicle of claim 3, wherein the vibratory system further includes a second shaft driven by the motor and coupled with the first eccentric weight, wherein the second shaft includes a plurality of second external helical splines.

8. The construction vehicle of claim 7, wherein the shaft member includes a plurality of second internal helical splines adapted to engage with the plurality of second external helical splines on the second shaft.

9. The construction vehicle of claim 1, wherein the fork includes a first fork arm pivotally coupled to the housing member at a first pivot point and a second fork arm pivotally coupled to the housing member at a second pivot point.

10. The construction vehicle of claim 9, wherein the first fork arm is removably coupled with the second fork arm using a plurality of mechanical fasteners.

11. A compactor comprising:
- a frame;
- at least one drum supported by the frame; and
- a vibratory system mounted within the at least one drum, the vibratory system comprising:
  - a first eccentric weight;
  - a second eccentric weight concentric with the first eccentric weight; and
  - a shift assembly adapted to vary an amplitude of the vibratory system based on a change in a position of the first eccentric weight relative to the second eccentric weight, wherein the shift assembly includes:
    - a shaft member adapted to move along a first axis for changing the position of the first eccentric weight relative to the second eccentric weight;
    - an actuator disposed parallel to the shaft member; and
    - a fork assembly adapted to move the shaft member along the first axis based on an actuation of the actuator, wherein the fork assembly includes:
      - a fork defining a first end and a second end, wherein the fork is fixedly coupled to the actuator proximate to the first end;
      - a housing member concentrically disposed around the shaft member, wherein the fork is pivotally coupled to the housing member at a pair of pivot points defined proximate to the second end of the fork; and
      - a bearing member disposed between the housing member and the shaft member.

12. The compactor of claim 11, wherein the fork defines a first through-aperture adapted to receive a portion of the actuator for fixedly coupling the fork assembly with the actuator.

13. The compactor of claim 11, wherein the vibratory system further includes a motor adapted to spin each the first and second eccentric weights.

14. The compactor of claim 13, wherein the vibratory system further includes a third shaft driven by the motor and coupled with the second eccentric weight.

15. The compactor of claim 13, wherein the vibratory system further includes a first shaft driven by the motor, wherein the first shaft includes a plurality of first external helical splines.

16. The compactor of claim 15, wherein the shaft member includes a plurality of first internal helical splines adapted to engage with the plurality of first external helical splines on the first shaft.

17. The compactor of claim 13, wherein the vibratory system further includes a second shaft driven by the motor and coupled with the first eccentric weight, wherein the second shaft includes a plurality of second external helical splines.

18. The compactor of claim 17, wherein the shaft member includes a plurality of second internal helical splines adapted to engage with the plurality of second external helical splines on the second shaft.

19. The compactor of claim 11, wherein the fork includes a first fork arm pivotally coupled to the housing member at a first pivot point and a second fork arm pivotally coupled to the housing member at a second pivot point.

20. The compactor of claim 19, wherein the first fork arm is coupled with the second fork arm using a plurality of mechanical fasteners.

* * * * *